US006979945B2

(12) United States Patent
Lee

(10) Patent No.: US 6,979,945 B2
(45) Date of Patent: Dec. 27, 2005

(54) FERRITE CORE STRUCTURE FOR COLOR CATHODE RAY TUBE

(75) Inventor: Byung Tae Lee, Gyeongsangbook-do (KR)

(73) Assignee: LG. Philips Display Korea Co., Ltd., Gyeongsangbuk-do (KR)

( * ) Notice: Subject to any disclaimer, the term of this patent is extended or adjusted under 35 U.S.C. 154(b) by 197 days.

(21) Appl. No.: 10/705,912

(22) Filed: Nov. 13, 2003

(65) Prior Publication Data

US 2004/0145296 A1 Jul. 29, 2004

(30) Foreign Application Priority Data

Jan. 24, 2003 (KR) ..... 10-2003-0004905

(51) Int. Cl.[7] ..... H01J 29/70

(52) U.S. Cl. ..... 313/440; 335/297; 348/828

(58) Field of Search ..... 313/440; 348/828–830

(56) References Cited

U.S. PATENT DOCUMENTS

| | | | | |
|---|---|---|---|---|
| 5,763,995 | A | 6/1998 | Sano et al. | |
| 6,208,068 | B1 | 3/2001 | Lee et al. | |
| 6,380,698 | B1 * | 4/2002 | Dasgupta | 315/368.25 |
| 6,696,907 | B1 * | 2/2004 | Iwaya et al. | 335/210 |
| 6,914,505 | B2 * | 7/2005 | Taniwa | 335/210 |
| 2002/0140337 | A1 | 10/2002 | Kim et al. | |

FOREIGN PATENT DOCUMENTS

| | | |
|---|---|---|
| JP | 48-34349 | 10/1973 |
| JP | 56-063757 | 5/1981 |
| JP | 08-007792 | 1/1996 |
| JP | 2002-294165 | 10/2002 |

* cited by examiner

*Primary Examiner*—Edward J. Glick
*Assistant Examiner*—Elizabeth Keaney
(74) *Attorney, Agent, or Firm*—McKenna Long & Aldridge LLP

(57) ABSTRACT

A cathode ray tube having a ferrite core with a modified sectional configuration facilitates the correction of a mis-convergence along a diagonal direction of a screen, improves the efficiency with which electrons within electron beams are deflected, and is manufacturable via a simplified process.

24 Claims, 10 Drawing Sheets

FERRITE CORE STRUCTURE FOR COLOR CATHODE RAY TUBE

This application claims the benefit of Korean Patent Application No. 2003-04905, filed on Jan. 24, 2003, which is hereby incorporated by reference for all purposes as if fully set forth herein.

BACKGROUND OF THE INVENTION

1. Field of the Invention

The present invention relates to a cathode ray tube, and more particularly, to a cathode ray tube having a ferrite core with a modified sectional configuration to facilitate correction of a mis-convergence along a diagonal direction of a screen, to improve deflection efficiency, and simplify a process of manufacturing a ferrite core.

2. Background of the Related Art

FIG. 1 illustrates a related art color cathode ray tube.

Referring to FIG. 1, a related art color cathode ray tube includes a front glass panel 1 and a rear glass funnel 2 having a screen part fastened to the front glass panel 1 to form a vacuum tube. A fluorescent screen 13 is formed on the interior surface of the front glass panel 1 and an electron gun 8 is mounted to a neck part of the rear glass funnel 2 and oppose the fluorescent screen 13 for emitting electrons and thereby generate electron beams. A deflection yoke 9 is directly coupled to the neck part of the rear glass funnel 2 for deflecting electrons within the electron beams. Generally, the deflection yoke 9 includes a pair of horizontal deflection coils 21 for horizontally deflecting electrons within the electron beams; a pair of vertical deflection coils 22 for vertically deflecting electrons within the electron beams; a conically shaped ferrite core 24 for minimizing loss in the strength of a magnetic field generated by current flowing within the horizontal and vertical deflection coils 21 and 22, to thereby improve the efficiency with which the electrons are deflected (i.e., deflection efficiency); and a holder 23 for insulating the horizontal and vertical deflection coils 21 and 22.

Upon operation of the aforementioned color cathode ray tube, electrons within the electron beams are deflected by the deflection yoke in horizontal and vertical directions wherein the deflected electrons strike the fluorescent screen 13 on the front glass panel 1 to display a predetermined color image.

FIG. 2 illustrates a cross sectional view of a related art deflection yoke 9 shown in FIG. 1 taken along line A–A'.

Referring to FIG. 2, circular shaped horizontal deflection coils 21 are wound around an interior surface of the holder 23 having a circular cross section while circular shaped vertical deflection coils 22 are wound around an external surface of the holder 23. Further, the conically shaped ferrite core 24 is coupled to the external surface of the vertical deflection coils 22.

Upon operation of the related art deflection yoke 9, a current having a frequency of at least 15.75 KHz flows within the horizontal deflection coils 21 and induces a magnetic field capable of horizontally deflecting electrons within the electron beams. Further, a current having a frequency of 60 Hz flows within the vertical deflection coils 22 and induces a magnetic field capable of vertically deflecting electrons within the electron beams.

Generally, electrons within the electron beams are deflected via a deflection yoke 9, incorporating a self-convergence system, wherein a non-uniform magnetic field converges three electron beams (R, G, and B electron beams) generated by the electron gun 8, onto a screen without the use of extra circuits or devices. By adjusting the winding configuration (or turn) of the horizontal and vertical deflection coils 21 and 22, respectively, the self-convergence system generates barrel or pin-cushion shaped magnetic fields around portions of the deflection yoke 9 proximate the front glass panel 1, around portions of the deflection yoke 9 proximate the neck part of the funnel 2, and around central portion of the deflection yoke 9, wherein, based on their un-converged positions, the three electron beams are deflected differently to a predetermined region on the front glass panel 1. Use of the aforementioned horizontal and vertical deflection coils 21 and 22 typically are not sufficient to deflect electron beams to the predetermined region on the screen, thereby necessitating use of the aforementioned ferrite core 9.

The ferrite core 9 has a high magnetic permeability and minimizes the loss in the strength of the magnetic field in its the return path through the core 9 and consequently enhances the magnetic force of the deflection coils.

FIG. 3 illustrates a portion of the rear glass funnel 2 to which a RAC type deflection yoke is installed.

Referring to FIG. 3, the interior or exterior cross sections of the related art rear glass funnel 2, coupled to a RAC type deflection yoke, gradually changes from a substantially circular shape at the neck part to a substantially non-circular shape at the screen part (e.g., rectangular shape). The shape of the rear glass funnel 2 ensures that electron beams drawing a rectangular shaped raster on the fluorescent screen 13 form a rectangular shaped pattern within a passing region where the electron beams pass through the deflection yoke coupled to the rear glass funnel 2. Accordingly, the portion of the deflection yoke 9 proximate the screen part of the rear glass funnel 2 often has a rectangular cross section to improve deflection efficiency. Further, the portion of the ferrite core 24 proximate the screen part of the rear glass funnel 2 is also provided with a rectangular cross section. Providing the deflection yoke 9 and the ferrite core 24 with the aforementioned cross sections reduces power consumption of the deflection yoke 9.

FIG. 4 illustrates a related art RAC type deflection yoke having a rectangular cross section.

Referring to FIG. 4, the cross section of the deflection yoke 9, the interior and exterior cross sections of the ferrite core 24, and the cross sections of the horizontal and vertical deflection coils 21 and 22, respectively, are rectangular. The current required by the horizontal and vertical deflection coils 21 and 22, having rectangular cross sections as shown in FIG. 4, to deflect electrons within the electron beams is less than the current required by the horizontal and vertical deflection coils 21 and 22 having the substantially circular cross section as shown in FIG. 2, since the deflection coils shown in FIG. 4 are closer to the electrons within the electron beams than the deflection coils shown in FIG. 2.

For example, the distance between the electron beams and the horizontal and vertical deflection coils 21 and 22 in the deflection yoke having the rectangular shaped cross section is about 20% less than the distance between the electron beams and the horizontal and vertical deflection coils 21 and 22 in the deflection yoke having the substantially circular shaped cross section. As a result, the deflection efficiency of the deflection yoke 9 having the rectangular shaped cross section is increased by at least 15–20% over the deflection efficiency of the deflection yoke 9 having the substantially circular shaped cross section.

Deflection efficiency may be enhanced when the ferrite core 24 having the rectangular shaped cross section is included with the deflection yoke 9 having the rectangular shaped cross section. Accordingly, the interior surface of the rectangular ferrite core 24 is characterized by a horizontal interior surface diameter and a vertical interior surface diameter, different from the horizontal interior surface diameter. As the interior surface of the ferrite core 24 includes different diameters, the ferrite core must be processed with greater precision than that required to fabricate the ferrite core 24 shown in FIG. 2. Accordingly, an increased amount of time and money are required during a grinding process capable of increasing the size precision of interior surface of the ferrite core 24. Consequently, a production yield of the ferrite core 24 having the rectangular cross section is, at best, 50% of the production yield of the ferrite core 24 having the substantially circular cross section resulting in the unit price of the ferrite core 24 having the rectangular cross section being twice of the unit price of the ferrite core 24 having the substantially circular cross section.

To overcome the aforementioned problems with the RAC type deflection yoke, a Round Core Tetra Coil Combined deflection (hereinafter referred to as RTC) type deflection yoke has been proposed. The RTC type deflection yoke combines the horizontal and vertical deflection coils having the rectangular cross section as shown in FIG. 4 with the ferrite core including interior and exterior surfaces with the substantially circular cross section as shown in FIG. 2.

While the deflection efficiency of the RTC type deflection yoke 9 is 4–5% lower than that of the RAC type yoke including the deflection yoke 9 and ferrite core 24 with the rectangular cross sections as shown in FIG. 4, the RTC type deflection yoke 9 may be manufactured with reduced difficulty and reduced cost.

FIG. 5 illustrates a portion of an RAC type deflection yoke including a ferrite core, horizontal deflection coil, vertical deflection coil, and holder, each having a rectangular cross section while FIG. 6 illustrates a portion of an RTC type deflection yoke including a ferrite core having a substantially circular cross section and a horizontal deflection coil, vertical deflection coil, and holder each having a rectangular cross section.

Referring to FIG. 5, in RAC type deflection yokes, the cross section of the portion of the ferrite core 24 proximate the screen part of the rear glass funnel 2 (hereinafter referred to as the screen part of the ferrite core 24) is rectangular as are the cross sections of the deflection coils 21 and 22 such that a vertical distance 31 between the ferrite core 24 and the vertical (deflection coil 22, a diagonal distance 33 between the ferrite core 24 and the vertical deflection coil 22, and a horizontal distance 32 between the ferrite core 24 and the horizontal deflection coil 21 are all substantially the same.

Referring to FIG. 6, however, in an RTC type deflection yoke, the cross section of the portion of the ferrite core 24 proximate the screen part of the ferrite core 24 is substantially circular while the cross sections of the deflection coils 21 and 22 are rectangular such that the diagonal distance 33 between the ferrite core 24 and the vertical deflection coil 22 is less than the vertical distance 31 between the ferrite core 24 and the vertical deflection coil 22 as well as the horizontal distance 32 between the ferrite core 24 and the horizontal deflection coil 21 while the vertical and horizontal distances 31 and 32 are substantially the same. As a result, the strength of diagonally oriented magnetic fields becomes greater than the vertically and horizontally oriented magnetic fields. Consequently, a mis-convergence phenomenon occurs wherein deflections of the R, G, and B electron beams deviate along diagonal directions.

FIG. 7 illustrates the manifestation of the mis-convergence phenomenon in a related art RTC type deflection yoke.

Referring to FIG. 7, because the strength of diagonally oriented magnetic fields are generally greater than vertically and horizontally oriented magnetic fields in RTC type deflection yokes, vertically directed mis-convergences (e.g., PQV(−) and S3V(+)) and a horizontally directed mis-convergence (e.g., PQH(−)) are often observed at diagonal regions (e.g., corner regions) of the screen.

SUMMARY OF THE INVENTION

Accordingly, the present invention is directed to a cathode ray tube having a ferrite core with a modified circular cross section that substantially obviates one or more of the problems due to limitations and disadvantages of the related art.

An advantage of the present invention provides cathode ray tube having a deflection yoke incorporating a ferrite core having a rectangular cross section capable of being manufactured at a reduced cost of and of eliminating the occurrence of the mis-convergence phenomenon.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a cathode ray tube may, for example, include a panel; a fluorescent screen formed on an interior surface of the panel; a funnel having a screen part fastened to a rear surface of the panel thereby creating a vacuum tube; an electron gun mounted to a neck part of the funnel for emitting electrons within electron beams; and a deflection yoke capable of horizontally and vertically deflecting the electron beams, wherein the deflection yoke may, for example, include horizontal deflection coils and vertical deflection coils, wherein the cross section of a portion of the horizontal deflection coils and/or the vertical deflection coils proximate the panel is rectangular in shape; a holder for connecting and insulating the horizontal and vertical deflection coils; and a ferrite core coupled to an exterior of the vertical deflection coil, wherein a portion of the ferrite core proximate the panel includes an interior cross section having a modified circular shape wherein diagonal regions of the modified circular shape may be provided with a thickness smaller than horizontal or vertical regions of the modified circular shape.

In another aspect of the present invention, a cathode ray tube may, for example, include a panel; a fluorescent screen formed on an interior surface of the panel; a funnel having a screen part fastened to a rear surface of the panel thereby creating a vacuum tube; an electron gun mounted to a neck part of the funnel for emitting electrons within electron beams; and a deflection yoke capable of horizontally and vertically deflecting the electron beams, wherein the deflection yoke may, for example, include horizontal deflection coils and vertical deflection coils, wherein the cross section of a portion of the horizontal deflection coils and/or the vertical deflection coils proximate the panel is rectangular in shape; a holder for connecting and insulating the horizontal and vertical deflection coils; and a ferrite core coupled to an exterior of the vertical deflection coil, wherein a portion of the ferrite core proximate the neck part of the funnel includes exterior and interior cross sections that are substantially circular in shape, wherein a portion of the ferrite core proximate the panel includes an exterior cross section that is substantially circular in shape, and wherein the portion of the ferrite core proximate the panel includes an interior cross section that is rectangular in shape.

In yet another aspect of the present invention, a cathode ray tube may, for example, include a panel; a fluorescent screen formed on an interior surface of the panel; a funnel having a screen part fastened to a rear surface of the panel thereby creating a vacuum tube; an electron gun mounted to a neck part of the funnel for emitting electrons within electron beams; and a deflection yoke capable of horizontally and vertically deflecting the electron beams, wherein the deflection yoke may, for example, include horizontal deflection coils and vertical deflection coils, wherein the cross section of a portion of the horizontal deflection coils and/or the vertical deflection coils proximate the panel is rectangular in shape; a holder for connecting and insulating the horizontal and vertical deflection coils; and a ferrite core coupled to an exterior of the vertical deflection coil, wherein a portion of the ferrite core proximate the neck part of the funnel includes exterior and interior cross sections that are substantially circular in shape, wherein a portion of the ferrite core proximate the panel includes an exterior cross section that is substantially circular in shape, wherein the portion of the ferrite core proximate the panel includes an interior cross section that is rectangular in shape, wherein the interior cross section of the ferrite core includes a diagonally arranged curvature, a horizontally arranged curvature, and a vertically arranged curvature, wherein the diagonally arranged curvature is smaller than the horizontally and vertically arranged curvatures.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF ILLUSTRATED EMBODIMENTS

Reference will now be made in detail to embodiments of the present invention, examples of which is illustrated in the accompanying drawings.

Figure 8:
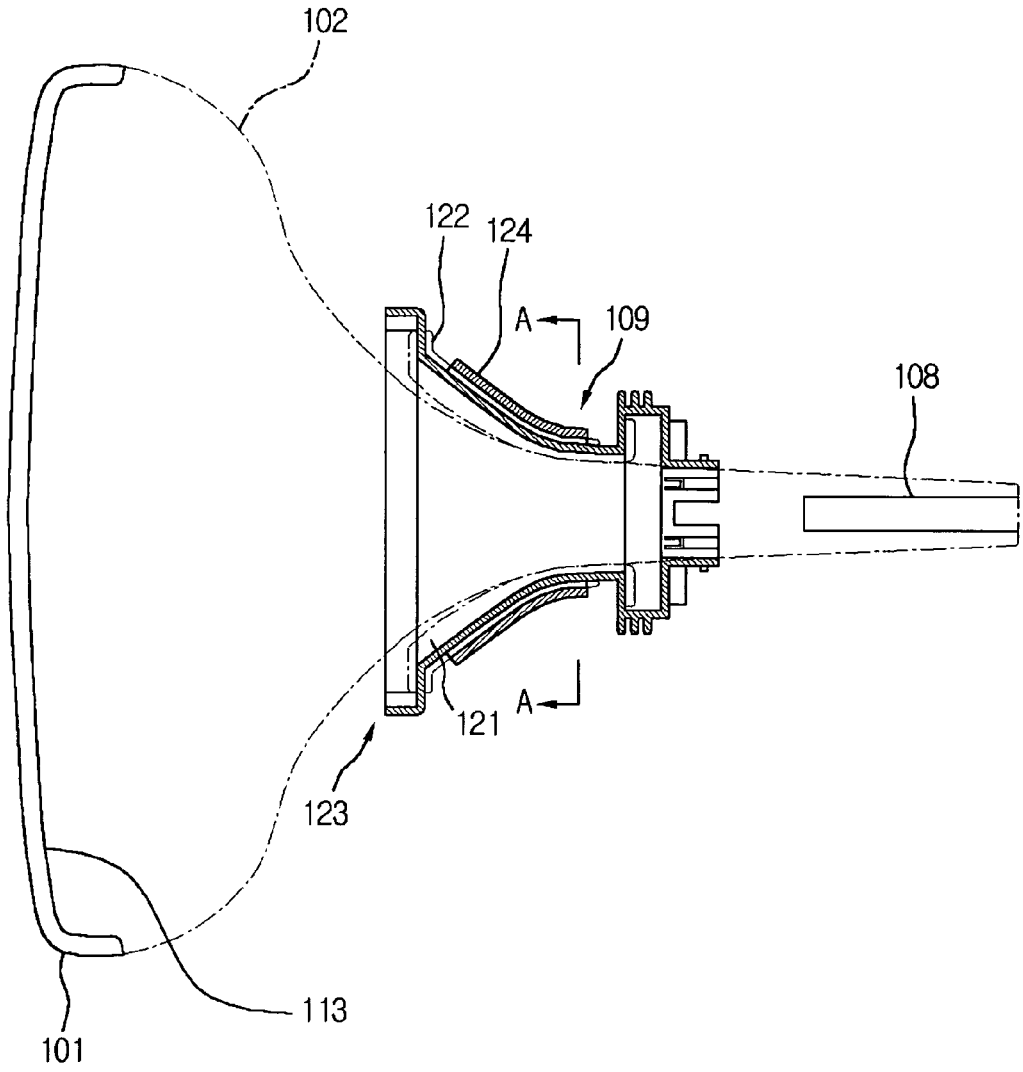
FIG. 8 illustrates a color cathode ray tube in accordance with the principles of the present invention.

FIG. 8 illustrates a related art color cathode ray tube.

Referring to FIG. 8, a color cathode ray tube according to the present invention may, for example, include a front glass panel 101 and a rear glass funnel 102 having a screen part fastened to the front glass panel 101 to form a vacuum tube. A fluorescent screen 113 may be formed on the interior surface of the front glass panel 101 and an electron gun 108 may be mounted to a neck part of the rear glass funnel 102 and oppose the fluorescent screen 113 for emitting electrons and thereby generate electron beams. A deflection yoke 109 may be directly coupled to the neck part of the rear glass funnel 102 for deflecting electrons within the electron beams. Generally, the deflection yoke 109 may, for example, include a pair of horizontal deflection coils 121 for horizontally deflecting electrons within the electron beams; a pair of vertical deflection coils 122 for vertically deflecting electrons within the electron beams; a conically shaped ferrite core 124 for minimizing loss in the strength of a magnetic field generated by current flowing within the horizontal and vertical deflection coils 121 and 122, to thereby improve the deflection efficiency; and a holder 123 for insulating the horizontal and vertical deflection coils 121 and 122.

Upon operation of the color cathode ray tube of the present invention, electrons within the electron beams may be deflected by the deflection yoke in horizontal and vertical directions wherein the deflected electrons strike the fluorescent screen 113 on the front glass panel 101 to display a predetermined color image.

Figure 9:
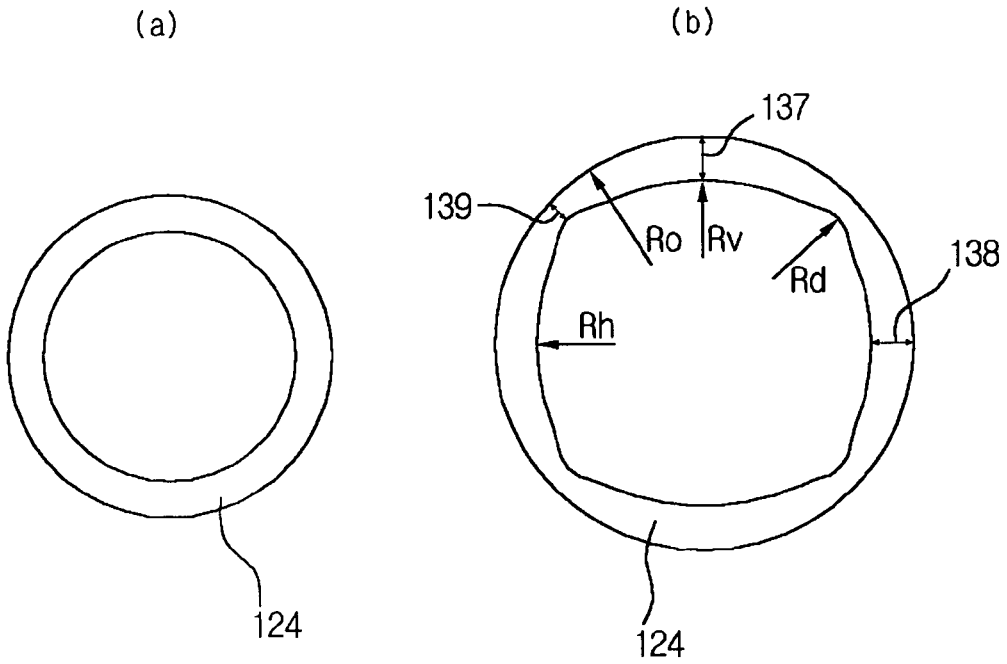
FIG. 9 illustrates cross sectional views of portions of a ferrite core of a cathode ray tube proximate a panel and a neck part of a funnel in accordance with one aspect of the present invention.

FIG. 9 illustrates cross sectional views of portions of a ferrite core of a cathode ray tube proximate a panel and a neck part of a funnel in accordance with one aspect of the present invention.

Referring to FIG. 9(*a*), a portion of the ferrite core 124 proximate the neck part of the funnel 102 (hereinafter referred to as the neck part of the ferrite core 124) may include an interior cross section that is substantially conformal to the neck part of the funnel 102. In one aspect of the present invention, the interior cross section of the neck part of the ferrite core 124 may be substantially circular. Further, the neck part of the ferrite core 124 may include an exterior cross section that may be characterized by substantially any shape. In one aspect of the present invention, the exterior cross section of the neck part of the ferrite core 124 may be substantially circular to facilitate fabrication of the ferrite core 124.

Referring to FIG. 9(*b*), a portion of the ferrite core 124 proximate the panel 101 (hereinafter referred to as the screen part of the ferrite core 124) may include an exterior cross section that is substantially circular to facilitate fabrication of the ferrite core 124. Further, the screen part of the ferrite core 124 may include an interior cross section having a modified circular shape (e.g., a non-circular shape) wherein a diagonal thickness 139 of the ferrite core 124 is less than a vertical thickness 137 or a horizontal thickness 138 of the ferrite core 124. In one aspect of the present invention, an opening defined by the neck part of the ferrite core 124 is narrower than an opening defined by the screen part of the ferrite core 124.

In one aspect of the present invention, the diagonal thickness 139 of the screen part of the ferrite core 124 may be determined based on the structural strength of the ferrite core 124. In another aspect of the present invention, the horizontal and vertical thicknesses 138 and 137, respectively, may substantially equal. In still another aspect of the present invention, the diagonal thickness 139 of the screen part of the ferrite core 124 may be about 1.5 mm to about 6 mm. In yet another aspect of the present invention, the vertical thickness 137 of the screen part of the ferrite core 124 may be about 4 mm to about 8 mm. In still another aspect of the present invention, the horizontal thickness 138 of the screen part of the ferrite core 124 may be about 4 mm to about 8 mm.

According to the principles of the present invention, the modified circular shape may include a nonzero diagonally arranged curvature, a horizontally arranged curvature, and a vertically arranged curvature, wherein the diagonally arranged curvature is smaller than the horizontally and vertically arranged curvatures. In one aspect of the present invention, the horizontally and vertically arranged curvatures may be nonzero. In one aspect of the present invention, the curvature of the exterior cross section of the screen part of the ferrite core 124 may have a radius Ro while the diagonally arranged curvature of the interior cross section of the screen part of the ferrite core 124 may have a radius Rd, the horizontally arranged curvature may have a radius Rv, and the vertically arranged curvature may have a radius is represented as Rh. In another aspect of the present invention $Ro \leqq Rh$. In yet another aspect of the present invention, $Ro \leqq Rv$. In still another aspect of the present invention, $Rd < Rh$, and $Rd < Rv$. In yet another aspect of the present invention, Rh may be substantially equal to Rv. In a further aspect of the present invention, the diagonally arranged curvature may be arranged between about 30° to about 60° from the horizontal axis of the ferrite core.

Figure 10:
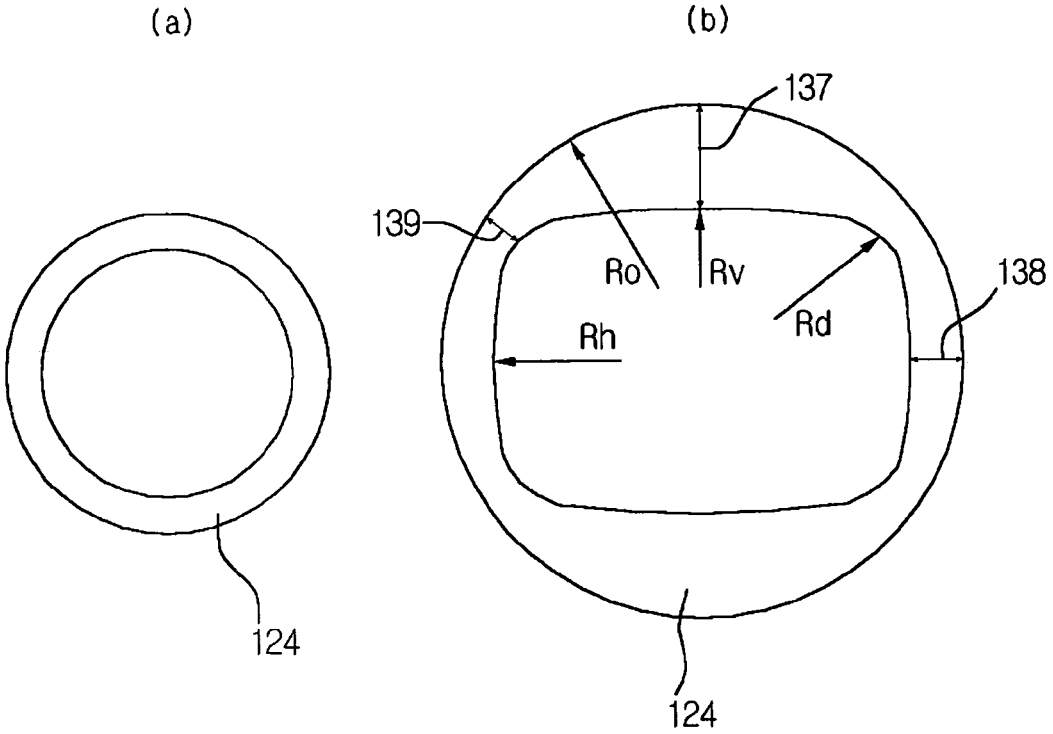
FIG. 10 illustrates cross sectional views of portions of a ferrite core of a cathode ray tube proximate a panel and a neck part of a funnel in accordance with another aspect of the present invention.

FIG. 10 illustrates cross sectional views of portions of a ferrite core of a cathode ray tube proximate a panel and a neck part of a funnel in accordance with another aspect of the present invention.

Referring to FIG. 10(*a*), the neck part of the ferrite core 124 may include interior and exterior cross sections that are substantially circular while, referring to FIG. 10(*b*), the screen part of the ferrite core 124 may include an exterior cross section that is substantially circular, to facilitate fabrication of the ferrite core 124, and an interior cross section that is transversely elliptical/oblong (e.g., substantially rectangular). In one aspect of the present invention, the interior cross section is substantially rectangular such that diagonal thickness 139 is smaller than the vertical thickness 137 and the horizontal thickness 138, determined based on the structural strength of the ferrite core 124. In another aspect of the present invention, the horizontal and vertical thicknesses 138 and 137, respectively, may not be substantially equal. In yet another aspect of the present invention, the vertical thickness 137 may be greater than the horizontal thickness 138. In still another aspect of the present invention, the horizontal thickness 138 may be greater than the vertical thickness 137. In another aspect of the present invention, the diagonal thickness 139 of the screen part of the ferrite core 124 may be about 1.5 mm to about 6 mm. In yet another aspect of the present invention, the vertical thickness 137 of the screen part of the ferrite core 124 may be about 4 mm to about 8 mm. In still another aspect of the present invention, the horizontal thickness 138 of the screen part of the ferrite core 124 may be about 4 mm to about 8 mm.

According to the principles of the present invention, the interior rectangular cross section may include a nonzero diagonally arranged curvature, a horizontally arranged curvature, and a vertically arranged curvature, wherein the diagonally arranged curvature is smaller than the horizontally and vertically arranged curvatures. In one aspect of the present invention, the horizontally and vertically arranged curvatures may be nonzero. In one aspect of the present invention, the curvature of the exterior cross section of the screen part of the ferrite core 124 have a radius Ro while the diagonally arranged curvature of the interior cross section of the screen part of the ferrite core 124 may have a radius Rd, the horizontally arranged curvature may have a radius Rv, and the vertically arranged curvature may have a radius Rh. In another aspect of the present invention $Ro \leqq Rh$. In yet another aspect of the present invention, $Ro \leqq Rv$. In still another aspect of the present invention, $Rd < Rh$, and $Rd < Rv$. In yet another aspect of the present invention, Rh may be substantially equal to Rv. In a further aspect of the present invention, the diagonally arranged curvature may be arranged between about 30° to about 60° from the horizontal axis.

Figure 11:
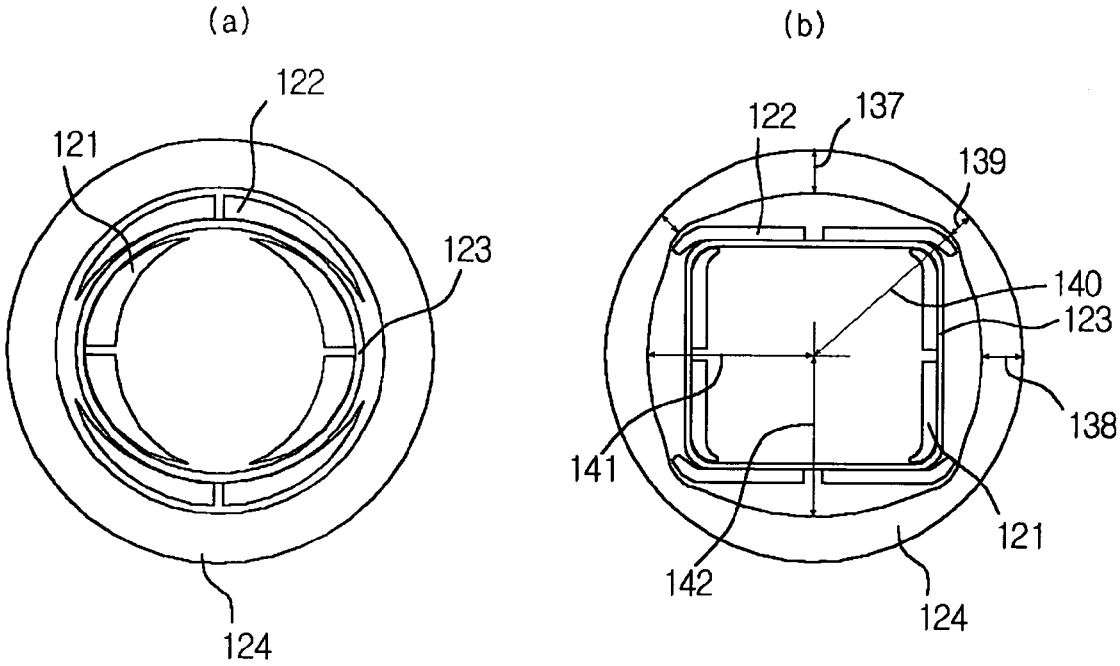
FIG. 11 illustrates cross sectional views of portions of a ferrite core of a cathode ray tube proximate a panel and a neck part of a funnel including horizontal deflection coils, vertical deflection coils, and a holder in accordance with one aspect of the present invention.

FIG. 11 illustrates cross sectional views of portions of a ferrite core of a cathode ray tube proximate a panel and a neck part of a funnel including horizontal deflection coils, vertical deflection coils, and a holder in accordance with one aspect of the present invention.

Referring to FIG. 11(*a*), the interior and exterior cross sections of the neck part of the ferrite core 124 may be substantially circular as well as the interior and exterior cross sections of the horizontal deflection coil 121, vertical deflection coil 122, and holder 123. As mentioned above, and with reference to FIG. 11(*b*), the exterior cross section of the screen part of the ferrite core 124 may be substantially circular while the interior cross section may have a modified circular shape, wherein a diagonal thickness 139 of the ferrite core is less than a vertical thickness 137 or a horizontal thickness 138 of the ferrite core 124. As the diagonal thickness 139 is reduced, the interior surface present at the diagonal regions of the screen part of the ferrite core 124 protrudes towards the exterior surface. As a result, loss in the magnetic field strength along diagonal directions may be increased as compared to losses in the magnetic field strength along the horizontal and vertical directions.

In accordance with the principles of the present invention, the cross sections of the horizontal and vertical deflection coils 121 and 122, respectively, proximate the panel 101

(hereinafter referred to as the screen part of the deflection coils) may be rectangular to thereby improve deflection efficiency.

Figure 12:
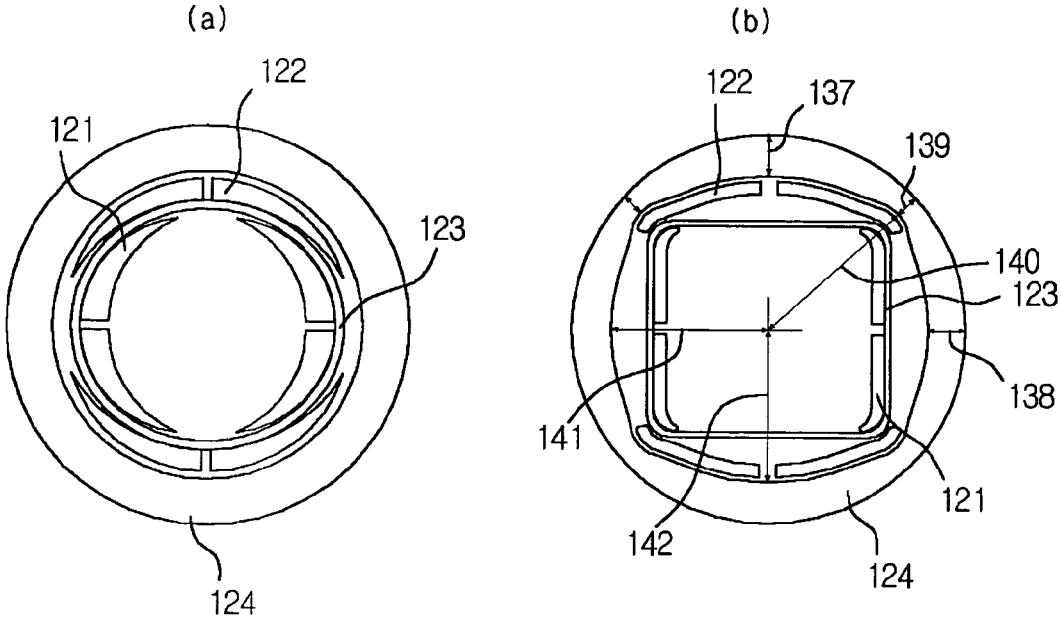
FIG. 12 illustrates cross sectional views of portions of a ferrite core of a cathode ray tube proximate a panel and a neck part of a funnel including horizontal deflection coils, vertical deflection coils, and a holder in accordance with another aspect of the present invention.

FIG. 12 illustrates cross sectional views of portions of a ferrite core of a cathode ray tube proximate a panel and a neck part of a funnel including horizontal deflection coils, vertical deflection coils, and a holder in accordance with another aspect of the present invention.

Referring to FIG. 12(*a*), the interior and exterior cross sections of the neck part of the ferrite core 124 may be substantially circular as well as the interior and exterior cross sections of the horizontal deflection coil 121, vertical deflection coil 122, and holder 123. As mentioned above, and with reference to FIG. 12(*b*), the exterior cross section of the screen part of the ferrite core 124 may be substantially circular, while the interior cross section may have a modified circular shape, wherein a diagonal thickness 139 of the ferrite core is less than a vertical thickness 137 or a horizontal thickness 138 of the ferrite core 124. As the diagonal thickness 139 is reduced, the interior surface present at the diagonal regions of the screen part of the ferrite core 124 protrudes towards the exterior surface. As a result, loss in the magnetic field strength along diagonal directions may be increased as compared to losses in the magnetic field strength along the horizontal and vertical directions.

In accordance with the principles of the present invention, the cross sections of at least one of the screen part of the horizontal deflection coil 121 and of the screen part of the vertical deflection coil 122 may be rectangular to thereby improve deflection efficiency. In one aspect of the present invention, the cross section of the screen part of the horizontal deflection coil 121 may be rectangular. In another aspect of the present invention, the cross section of the screen part of the vertical deflection coil 122 may be substantially circular.

As mentioned above with reference to FIGS. 9 to 12, the diagonal thickness 139 of the screen part of the ferrite core 124 may be reduced compared the horizontal and vertical thicknesses 138 and 139, respectively. Accordingly, the interior surface present at the diagonal regions of the screen part of the ferrite core 124 may protrude towards the exterior surface. As a result, loss in the magnetic field strength along diagonal directions may be selectively increased with respect to losses in the magnetic field strength along the horizontal and vertical directions.

As mentioned above with reference to FIG. 7, vertically and horizontally oriented magnetic fields in RTC type deflection yokes, vertically directed mis-convergences (e.g., PQV(−) and S3V(+)) and a horizontally directed mis-convergence (e.g., PQH(−)) are often observed at diagonal regions (e.g., corner regions) of the screen because the strength of diagonally oriented magnetic fields are generally greater than vertically and horizontally oriented magnetic fields. The mis-convergence phenomenon may, however, be minimized upon applying the principles of the present invention.

According to the principles of the present invention, the interior surface present at the diagonal regions of the screen part of the ferrite core 124 protrude towards the exterior surface, the diagonal distance 140, measured from the center to the interior surface of the screen part of the ferrite core 124, is equal to that of the aforementioned related art RTC type deflection yoke, while the vertical distance 142 and horizontal distance 141, measured from the center to the interior surface of the screen part of the ferrite core 124, may be less than that of the aforementioned related art RTC type deflection yoke. Accordingly, the vertical distance 131 between the screen part of the ferrite core 124 and the vertical deflection coil 122 and the horizontal distance 132 between the ferrite core 124 and the horizontal deflection coil 121 are reduced compared to equivalent distances of the aforementioned related art RTC type deflection yoke. Consequently, the deflection efficiency provided by the present invention may be about 4% to about 5% greater than that of the aforementioned related art RTC type deflection yoke including the ferrite core having the interior and exterior rectangular cross sections.

Further, according to the principles of the present invention, the interior surface at the diagonal region of the ferrite core 124 may substantially coincide with the exterior surface at the diagonal region of the vertical deflection coil 122. Therefore, unlike the aforementioned related art RTC type deflection yoke, the deflection yoke of the present invention may include a ferrite core 124 that is rendered substantially immobile. Use of the ferrite core 124 of the present invention is advantageous over use of the aforementioned related art RTC type deflection yoke incorporating the ferrite core having the circular cross section because the related art ferrite core is not easily mountable to the vertical deflection coils at the diagonal regions. Accordingly, fabrication of the related art RTC type deflection yoke may be made more difficult by the configuration of the interior surface of the related art ferrite core.

According to the principles of the present invention, the ferrite core 124 may be manufactured via a pre-molding process capable of forming the diagonal region within the interior surface to protrude towards the exterior surface. The pre-molding process may be followed by a grinding process wherein the interior surfaces of the ferrite core 124 are grinded in horizontal and vertical directions.

Figure 13:
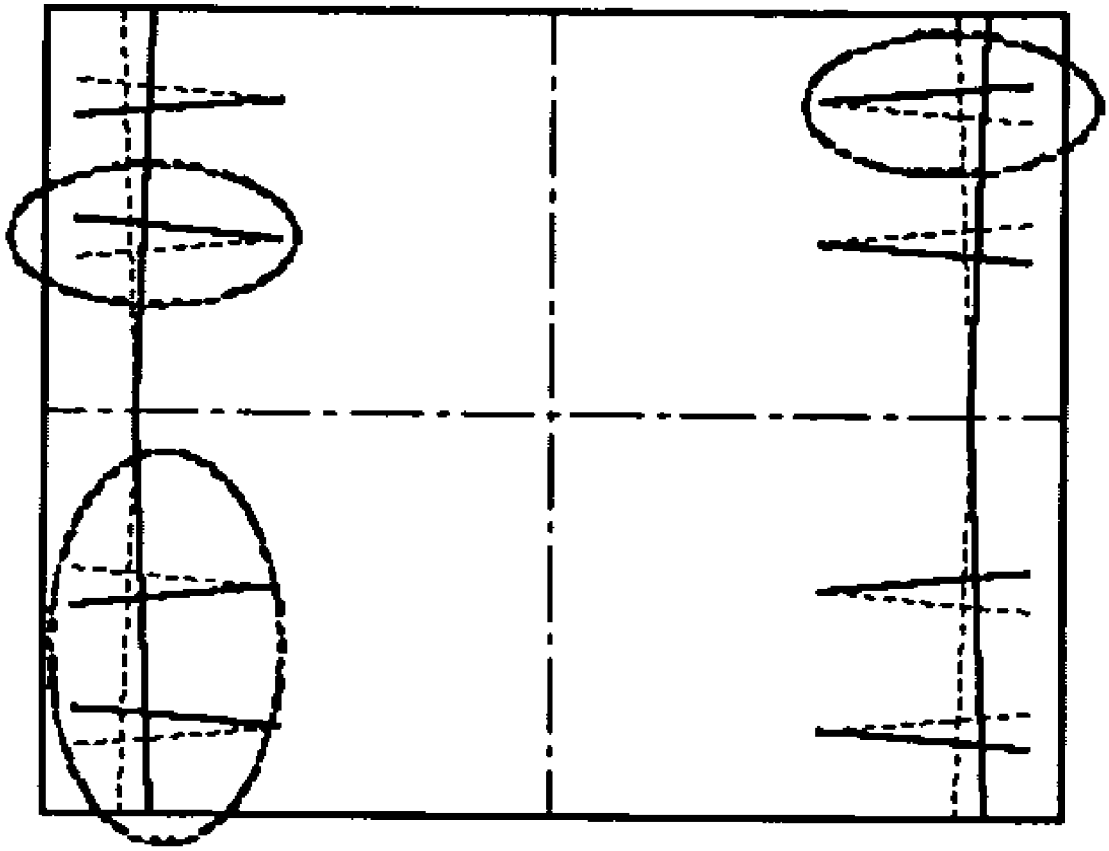
FIG. 13 illustrates the minimization of the mis-convergence phenomenon induced by the ferrite core of the present invention.

FIG. 13 illustrates the minimization of the mis-convergence phenomenon induced by the ferrite core of the present invention.

Figure 1:
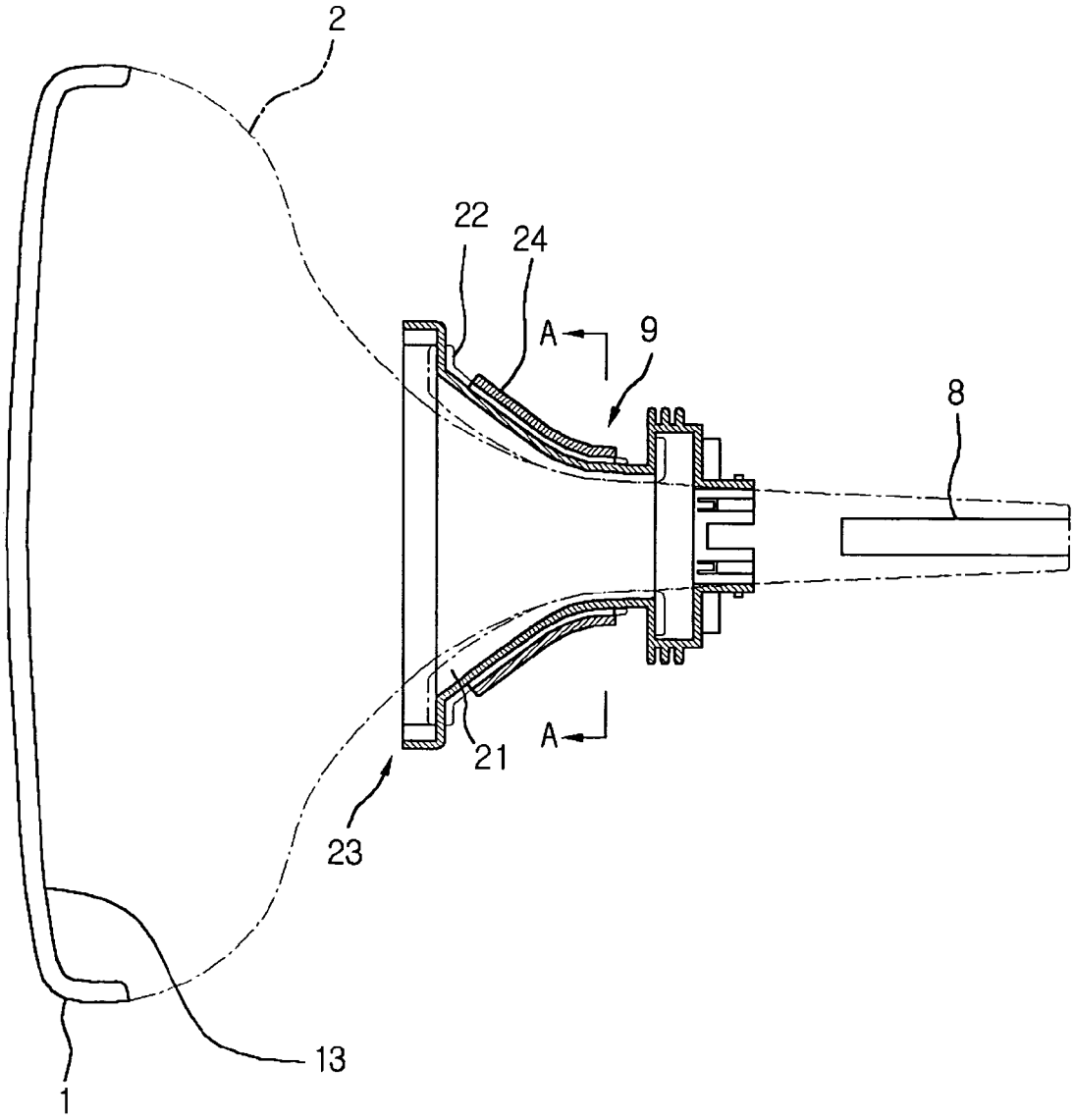
Fig.1 (Related Art)
FIG. 1 illustrates a related art color cathode ray tube.
Figure 2:
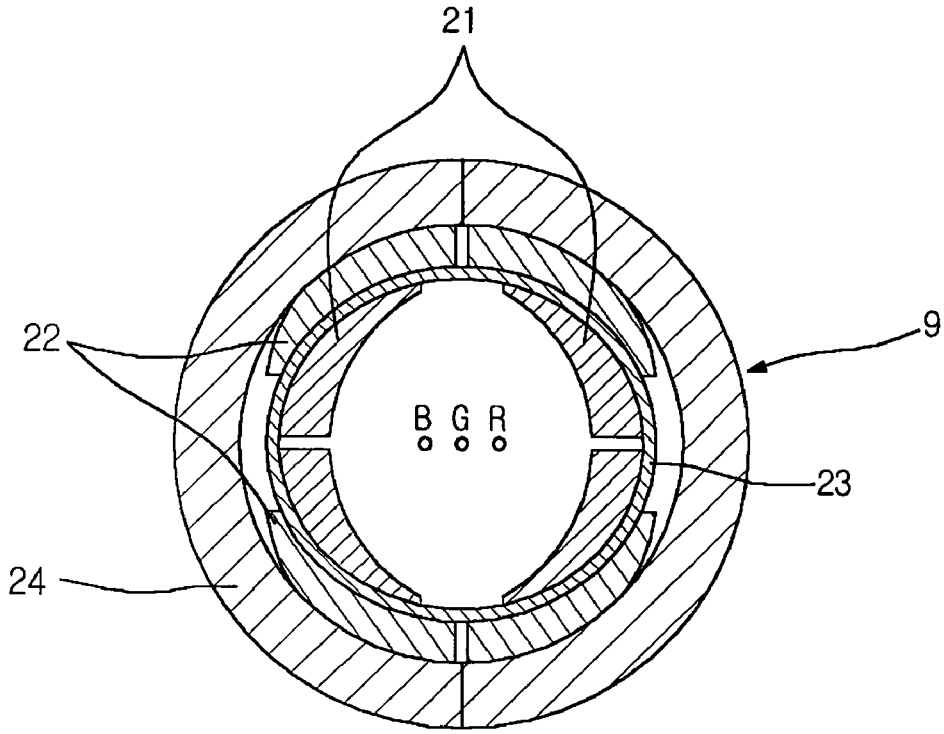
Fig.2 (Related Art)
FIG. 2 illustrates a cross sectional view of the related art deflection yoke shown in FIG. 1 taken along line A–A'.
Figure 3:
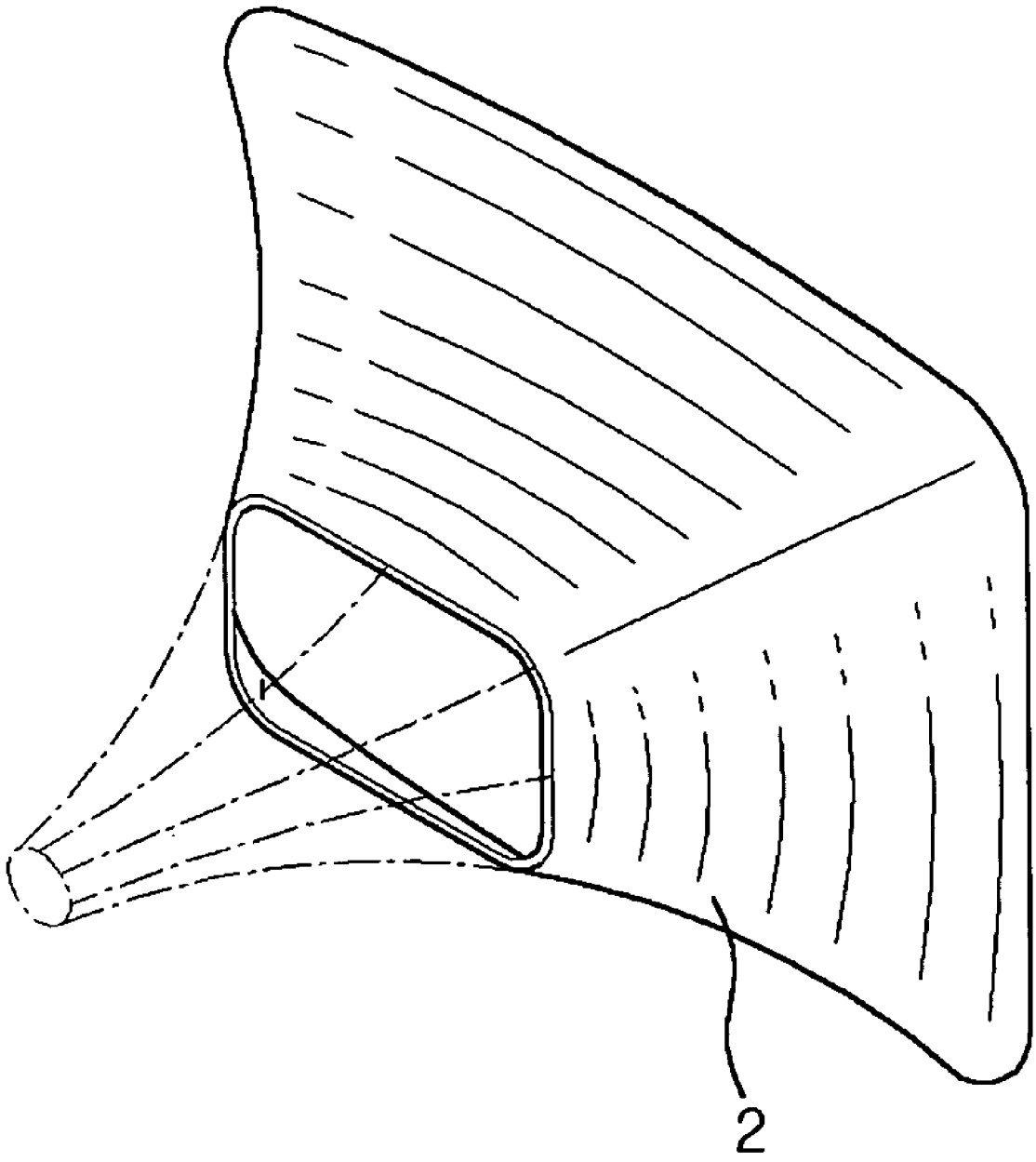
Fig.3 (Related Art)
FIG. 3 illustrates a portion of the rear glass funnel 2 to which a RAC type deflection yoke is installed.
Figure 4:
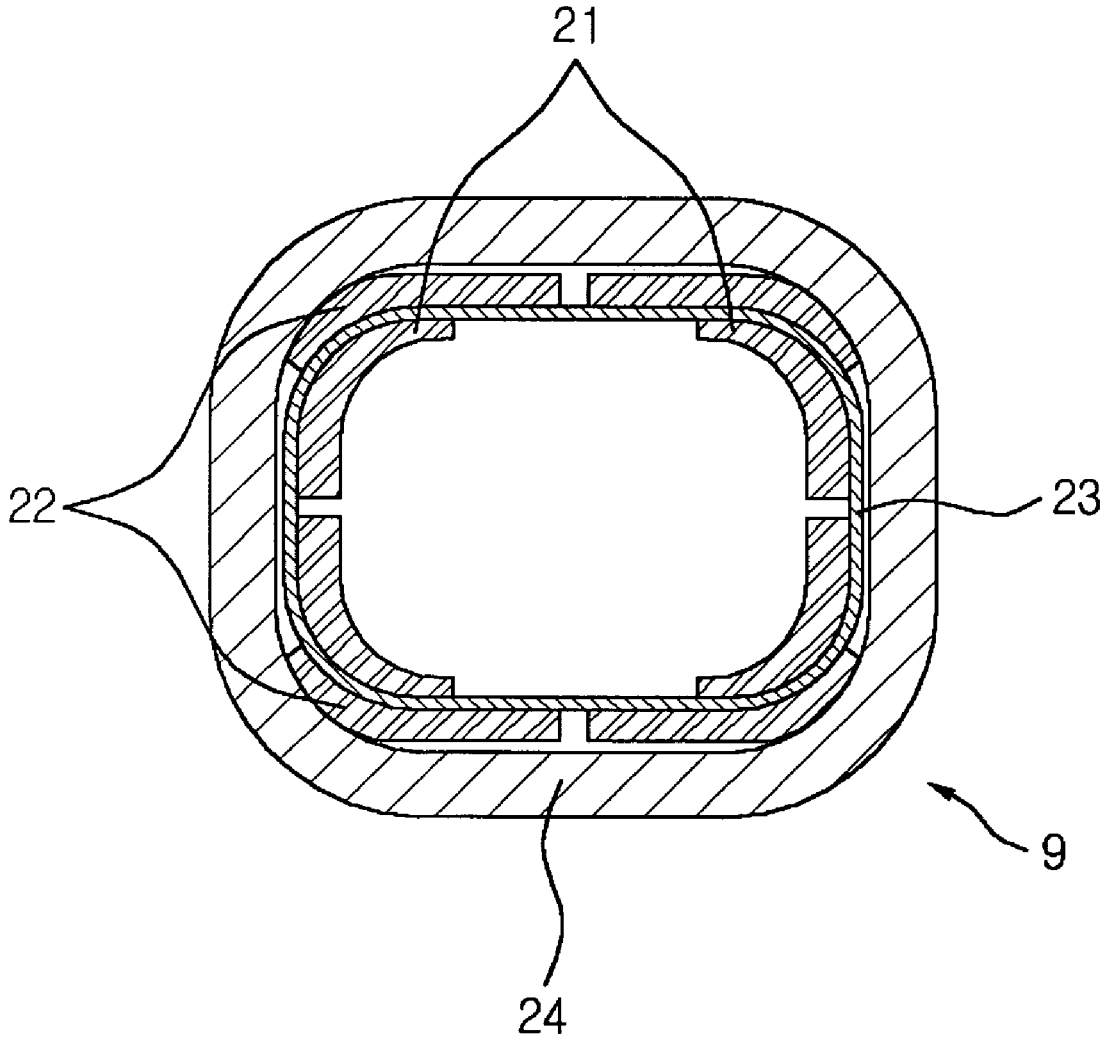
Fig.4 (Related Art)
FIG. 4 illustrates a related art RAC type deflection yoke having a rectangular cross section.
Figure 5:
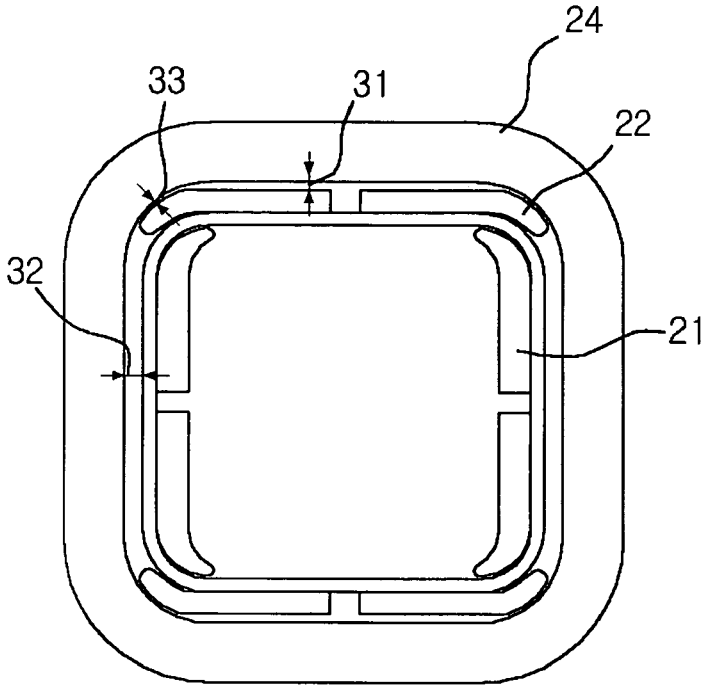
Fig.5 (Related Art)
FIG. 5 illustrates a related art ferrite core, horizontal deflection coil, vertical deflection coil, and holder, each having a rectangular cross section.
Figure 6:
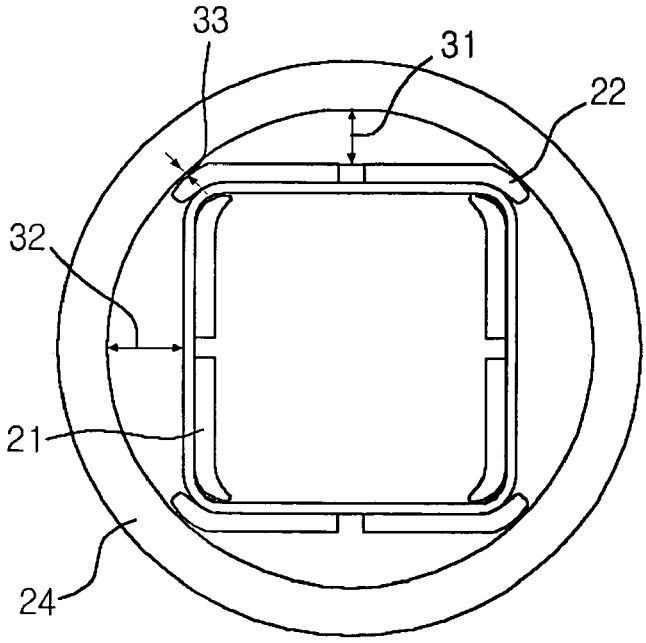
Fig.6 (Related Art)
FIG. 6 illustrates a related art ferrite core having a substantially circular cross section and a horizontal deflection coil, vertical deflection coil, and holder having a rectangular cross section.
Figure 7:
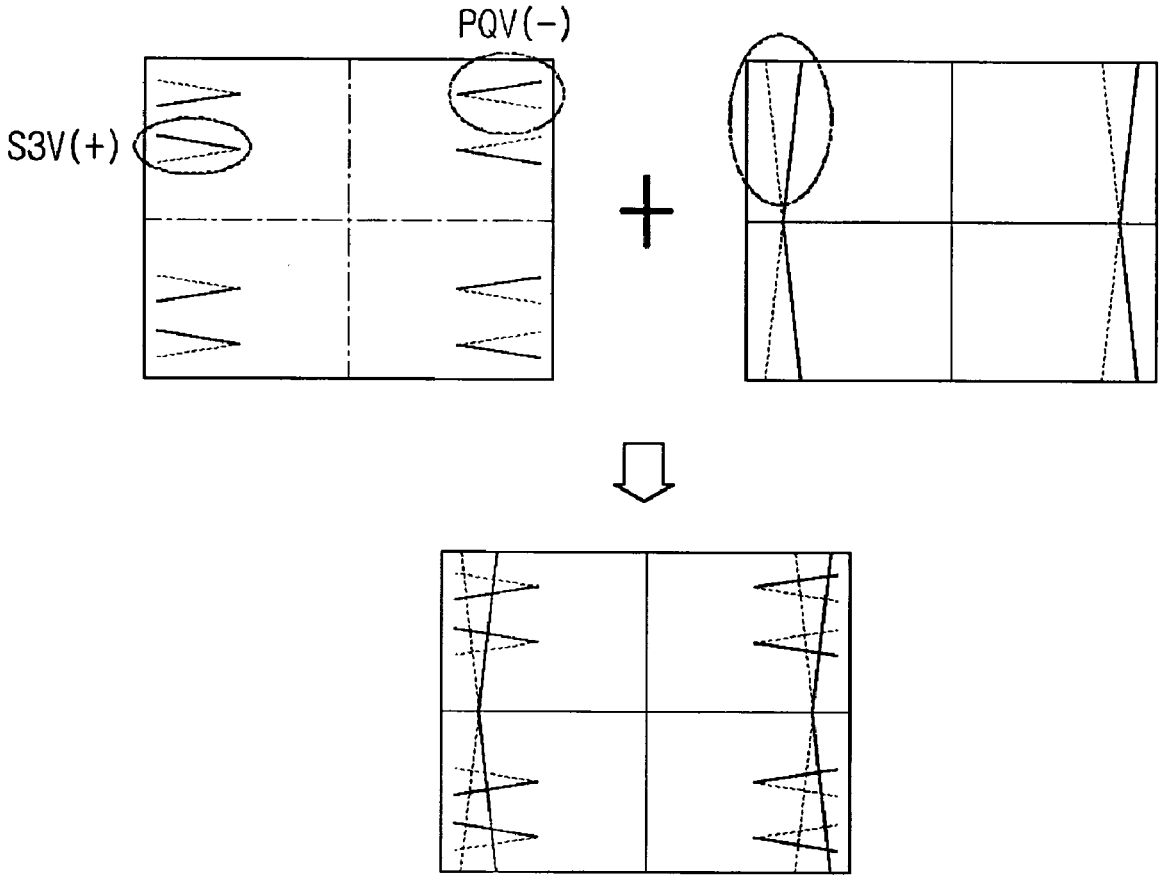
Fig.7 (Related Art)
FIG. 7 illustrates the manifestation of the mis-convergence phenomenon in a related art RTC type deflection yoke.

Compared to FIG. 7, the strength of the diagonally oriented magnetic fields may be reduced to below the strength of the diagonally oriented magnetic fields of the aforementioned related art RTC type deflection yoke. Accordingly, the vertically directed mis-convergences (e.g., PQV(−) and S3V(+)) and the horizontally directed mis-convergence (e.g., PQH(−)) may be may be minimized compared to the aforementioned mis-convergences of the related art.

Cathode ray tubes incorporating the deflection yoke of the present invention having the aforementioned ferrite core may be advantageously manufactured at a reduced cost and are capable of minimizing the emergence of the mis-convergence phenomenon present in the aforementioned related art RTC type deflection yoke.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A cathode ray tube, comprising:

a front panel;

a fluorescent screen formed on an interior surface of the panel;

a funnel fastened to the panel, the funnel including a neck part and a screen part opposing the neck part, wherein the screen part is fastened to the panel;

an electron gun coupled to the neck part for emitting electron beams, the electron beams formed of a plurality of electrons;

a deflection yoke for deflecting electrons within the electron beams in horizontal and vertical directions, wherein the deflection yoke includes horizontal deflection coils for horizontally deflecting electrons within the electron beams and vertical deflection coils for vertically deflecting electrons within the electron beams, wherein a portion of at least one of the horizontal and vertical deflection coils proximate the screen part has a roughly rectangular cross section;

a holder for holding and insulating the horizontal and vertical deflection coils; and a ferrite core exterior of the vertical deflection coils, wherein a cross section of a portion of the ferrite core proximate the screen part includes diagonal regions, horizontal regions, and vertical regions, wherein a thickness of the diagonal regions is less than thicknesses of the horizontal and vertical regions.

2. The cathode ray tube according to claim 1, wherein a cross section of a portion of the holder proximate the screen part is rectangular.

3. The cathode ray tube according to claim 1, wherein an interior surface of the funnel has a cross section, perpendicular to the axis of the funnel, that gradually changes from a substantially circular shape at the neck part to a substantially non-circular shape at the screen part.

4. The cathode ray tube according to claim 3, wherein an exterior surface of the funnel has a cross section, perpendicular to the axis of the funnel, that gradually changes from a substantially circular shape at the neck part to a substantially non-circular shape at the screen part.

5. The cathode ray tube according to claim 1, wherein an exterior surface of the funnel has a cross section, perpendicular to the axis of the funnel, that gradually changes from a substantially circular shape at the neck part to a substantially non-circular shape at the screen part.

6. The cathode ray tube according to claim 1, wherein the thickness of the diagonal regions of the cross section at the screen portion of the ferrite core is about 1.5 mm to about 6 mm.

7. The cathode ray tube according to claim 1, wherein the thickness of the horizontal regions of the cross section at the screen portion of the ferrite core is about 4 mm to about 8 mm.

8. The cathode ray tube according to claim 1, wherein the thickness of the vertical regions of the cross section at the screen portion of the ferrite core is about 4 mm to about 8 mm.

9. The cathode ray tube according to claim 1, wherein a cross section of a portion of the horizontal deflection coils proximate the screen part is rectangular.

10. The cathode ray tube according to claim 1, wherein a cross section of a portion of the vertical deflection coils proximate the screen part is substantially circular.

11. The cathode ray tube according to claim 1, wherein a cross section of a portion of the vertical deflection coils proximate the screen part is rectangular.

12. The cathode ray tube according to claim 1, wherein an exterior cross section of a portion of the ferrite core proximate the neck part is substantially circular.

13. The cathode ray tube according to claim 1, wherein an interior cross section of a portion of the ferrite core proximate the neck part is substantially circular.

14. The cathode ray tube according to claim 1, wherein an interior cross section of a portion of the ferrite core proximate the screen part is non-circular.

15. The cathode ray tube according to claim 14, wherein the interior cross section of the portion of the ferrite core proximate the screen part is rectangular.

16. The cathode ray tube according to claim 1, wherein an exterior cross section of a portion of the ferrite core proximate the screen part is substantially circular.

17. A cathode ray tube, comprising:

a front panel;

a fluorescent screen formed on an interior surface of the panel;

a funnel fastened to the panel, the funnel including a neck part and a screen part opposing the neck part, wherein the screen part is fastened to the panel;

an electron gun coupled to the neck part for emitting electron beams, the electron beams formed of a plurality of electrons;

a deflection yoke for deflecting electrons within the electron beams in horizontal and vertical directions, wherein the deflection yoke includes horizontal deflection coils for horizontally deflecting electrons within the electron beams and vertical deflection coils for vertically deflecting electrons within the electron beams, wherein a portion of at least one of the horizontal and vertical deflection coils proximate the screen part has a roughly rectangular cross section;

a holder for holding and insulating the horizontal and vertical deflection coils; and a ferrite core exterior of the vertical deflection coils, wherein an exterior cross section of a portion of the ferrite core proximate the neck part is substantially circular, wherein an interior cross section of the portion of the ferrite core proximate the neck part is substantially circular, wherein an exterior cross section of the ferrite core proximate the screen part is substantially circular, wherein an interior cross section of the ferrite core proximate the screen part is non-circular, wherein the interior cross section of the ferrite core proximate the screen part includes a diagonally arranged curvature, a horizontally arranged curvature, and a vertically arranged curvature, wherein the diagonally arranged curvature has a radius that is less than a radius of the horizontally and vertically arranged curvatures.

18. The cathode ray tube according to claim 17, wherein the substantially circular exterior cross section of the ferrite core proximate the neck part has a radius that is less than the radius of the horizontally arranged curvature.

19. The cathode ray tube according to claim 17, wherein the substantially circular exterior cross section of the ferrite core proximate the neck part has a radius that is substantially equal to the radius of the horizontally arranged curvature.

20. The cathode ray tube according to claim 17, wherein the substantially circular exterior cross section of the ferrite core proximate the neck part has a radius that is less than the radius of the vertically arranged curvature.

21. The cathode ray tube according to claim 17, wherein the substantially circular exterior cross section of the ferrite core proximate the neck part has a radius that is substantially equal to the radius of the vertically arranged curvature.

22. The cathode ray tube according to claim 17, wherein the radius of the horizontally arranged curvature is substantially equal to the radius of the vertically arranged curvature.

23. The cathode ray tube according to claim 17, wherein the diagonally arranged curvature is arranged between about 30° and about 60° from the horizontal axis of the ferrite core.

24. A deflection yoke of a cathode ray tube, comprising:

a ferrite core having a first end, a second end opposing the first end, an interior surface, and an exterior surface, wherein a portion of the interior surface proximate the first end has a cross section that is non-circular and wherein a portion of the exterior surface proximate the first end has a cross section that is circular; and a plurality of vertical deflection coils and a plurality of horizontal deflection coils within the ferrite core, wherein a portion of the plurality of at least one of the vertical and horizontal deflection coils proximate the first end has a cross section that is rectangular.

* * * * *